US007025687B2

(12) United States Patent
Bouchard

(10) Patent No.: US 7,025,687 B2
(45) Date of Patent: Apr. 11, 2006

(54) BOWLING CENTER CONTROL SYSTEM

(75) Inventor: Roland C. Bouchard, Grand Rapids, MI (US)

(73) Assignee: Brunswick Bowling & Billiards Corporation, Muskegon, MI (US)

( * ) Notice: Subject to any disclaimer, the term of this patent is extended or adjusted under 35 U.S.C. 154(b) by 0 days.

(21) Appl. No.: 10/862,945

(22) Filed: Jun. 8, 2004

(65) Prior Publication Data

US 2005/0101397 A1 May 12, 2005

Related U.S. Application Data

(60) Provisional application No. 60/518,023, filed on Nov. 6, 2003.

(51) Int. Cl.
*A63D 1/00* (2006.01)

(52) U.S. Cl. ..... 473/54; 473/115

(58) Field of Classification Search ..... 473/54, 473/57, 58, 70–73, 83–84, 86; 340/323 R, 340/323 B; 434/249; 700/91–92; 463/7, 463/30–31, 35–37
See application file for complete search history.

(56) References Cited

U.S. PATENT DOCUMENTS

| | | | | |
|---|---|---|---|---|
| 5,101,354 A | | 3/1992 | Mowers et al. | 364/410 |
| 5,198,976 A | | 3/1993 | Form et al. | 364/410 |
| 5,255,185 A | | 10/1993 | Mowers et al. | 364/411 |
| 5,618,238 A | * | 4/1997 | Kruse et al. | 473/70 |
| 5,743,745 A | | 4/1998 | Reintjes | 434/307 |
| 5,842,929 A | | 12/1998 | Moody et al. | 473/70 |
| 5,882,263 A | * | 3/1999 | Chung | 473/70 |
| 6,031,343 A | * | 2/2000 | Recknagel et al. | 315/292 |
| 6,270,421 B1 | * | 8/2001 | Tsujita | 473/54 |
| 6,304,789 B1 | | 10/2001 | Shea | 700/92 |
| 6,441,724 B1 | | 8/2002 | Stirling et al. | 340/323 |
| 6,464,595 B1 | | 10/2002 | Tsujita | 473/70 |
| 6,580,954 B1 | | 6/2003 | Shea | 700/91 |
| 6,623,369 B1 | * | 9/2003 | Shea | 473/57 |
| 2004/0142747 A1 | * | 7/2004 | Pryzby | 463/35 |

FOREIGN PATENT DOCUMENTS

WO WO 03/078004 A1 9/2003

* cited by examiner

*Primary Examiner*—Xuan M. Thai
*Assistant Examiner*—Alex F. R. P. Rada, II
(74) *Attorney, Agent, or Firm*—Dykema Gossett PLLC

(57) ABSTRACT

A bowling center control system includes an input device configured for input of a bowler's selection of one of a plurality of entertainment styles, wherein each style has predetermined audiovisual, lighting and sound characteristics. A bowling center control system further includes a multimedia server in communication with the input device. The multimedia server is configured with multimedia content corresponding to each of the characteristics of each entertainment style. The multimedia server is further configured to associate predetermined portions of the content with the bowler in response to the bowler's selected style. The multimedia server is yet further configured to generate an output signal operative to reproduce at least certain portions of the predetermined portions of the content corresponding to the characteristics of the selected entertainment style in response to a signal indicative of an occurrence of a bowling event associated with the bowler.

27 Claims, 8 Drawing Sheets

BOWLING CENTER CONTROL SYSTEM

CROSS REFERENCE TO RELATED APPLICATIONS

This application claims the benefit of U.S. Provisional Patent Application No. 60/518,023 filed Nov. 6, 2003, which is hereby incorporated by reference in its entirety.

FIELD OF THE INVENTION

This invention relates generally to a bowling center control system, and more particularly to a bowling center control system wherein audiovisual, light, and sound characteristics of the system are integrated into one, user customized entertainment system.

BACKGROUND OF THE INVENTION

Bowling centers have evolved from systems wherein the pins from a bowling game had to be manually set up on a pin deck located at the end of a bowling lane, to systems wherein the bowling pins are automatically set up and cleared from the pin deck by automatic pinsetters. From systems wherein a bowler's score had to be manually recorded and calculated by a bowler, to systems wherein a bowler's score is automatically computed using an automatic scoring system comprised of, for example purposes, the combination of a pinfall detector and a central processing unit, and then displayed on a monitor proximate to the lane on which the bowler is bowling.

In more recent times, bowling center control systems have been developed wherein a bowler can have a measure of interaction with the system. In these systems, a bowler can use an input device, such as a keypad or touch screen, to enter his name into the system and onto the displayed scoresheet, and to manually correct a scoring error with a few key strokes on the keypad or touch screen. These systems have been further developed to provide more functionality, such as ordering food or drinks from a snack bar, and have added more entertainment features such as the display of graphics or graphic animations in response to the occurrence of a particular bowling event, including but not limited to gutter balls, splits, strikes and spares, for example. These systems have been further developed to allow for the synchronization of the lighting system with the changing beats or rhythms of the sound system.

An example of a conventional bowling center control system may include the following. An automatic scoring system comprised of a lane server unit and a pinfall detector is provided. The lane server is configured to receive pinfall or scoring information from the pinfall detector for a pair of lanes. The lane server is further configured to compute the score for a particular bowler or team bowling on at least one of the pair of lanes. The lane server then generates a suitable display image destined for a corresponding display monitor (s) so that the bowler can see his score for a particular throw or his aggregate score for his game. The lane server is further configured to transmit the scoring information to a center management system, which has global control over the bowling center, via a network such as an Ethernet network. The lane server is also configured to deliver graphics or graphic animations (i.e., brief animations) to the monitor(s) upon recognizing a particular bowling event such as a strike or spare. The system further includes a keypad corresponding to at least each individual lane that is in communication with the lane server unit to allow a bowler to enter his name into the system and computerized scoresheet, or to correct a scoring error. An audiovisual system is also in communication with the center management system to allow for the bowling center to control the broadcast of messages or other audiovisual features, such as movies or television programs, to the overhead monitors. Additionally, lighting and sound systems are included, but are separate and distinct from the scoring system. In sum, there are lighting, sound and audiovisual systems operating at the same time, but through different subsystems.

Existing systems, such as the one set forth above, however, have numerous shortcomings. One shortcoming is that current bowling center control systems have relatively separate and distinct systems for each of the audiovisual, lighting and sound characteristics. This requires additional hardware and software, and does not provide for ideal control or presentation of the entertainment environment.

There is, therefore, a need for a bowling center control system that will minimize and/or eliminate one or more of the above-identified deficiencies.

SUMMARY OF INVENTION

A bowling center control system is presented. The bowling center control system includes an input device configured for input of a bowler's selection of one of a plurality of entertainment styles, each style having predetermined audiovisual, lighting and sound characteristics. The bowling center control system further includes a multimedia server that is in communication with the input device. The multimedia server is configured with multimedia content corresponding to each of the audiovisual, lighting and sound characteristics of the plurality of entertainment styles. The server is further configured to associate predetermined portions of the multimedia content with the bowler in response to the bowler's selected entertainment style. The server is still further configured to generate an output signal operative to reproduce at least certain portions of the predetermined content associated with the audiovisual, lighting and sound characteristics of the bowler's selected entertainment style in response to a signal indicative of the occurrence of a bowling event associated with the bowler.

A method of controlling the delivery of entertainment in a bowling center is also presented.

DETAILED DESCRIPTION OF THE INVENTION

Figure 1:
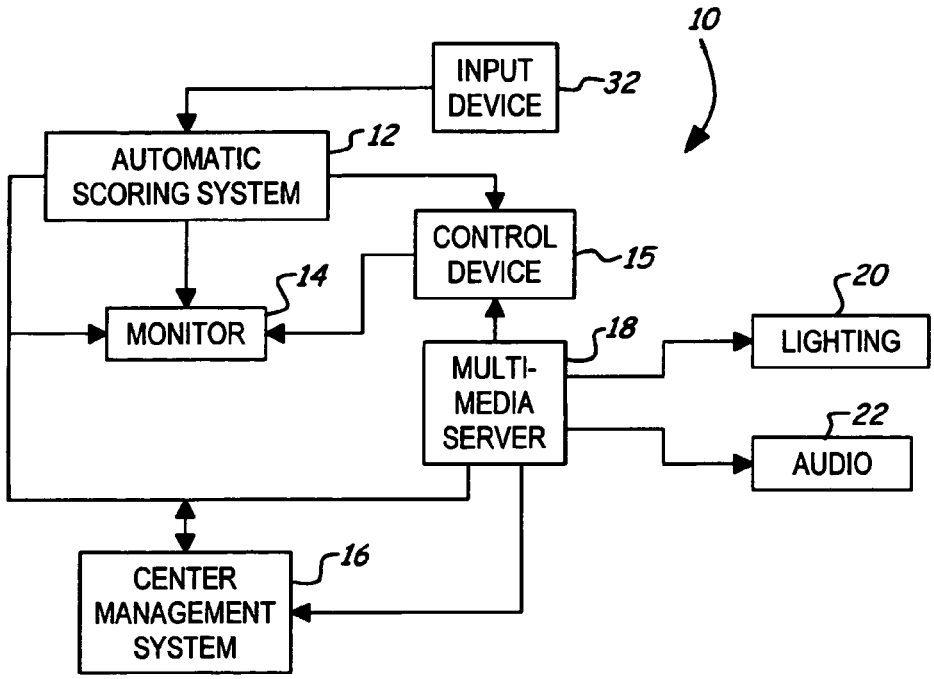
FIG. 1 is a schematic block diagram of a bowling center control system in accordance with the present invention.

Referring now to the drawings wherein like reference numerals are used to identify identical components in the various views, FIG. 1 illustrates a schematic block diagram of an inventive multimedia bowling center control system 10. In one embodiment, bowling center control system 10 includes an automatic scoring system 12; at least one display monitor 14 in communication with scoring system 12; a center management system 16 that receives information from scoring system 12 and that is in communication with display monitor 14; and a multimedia server 18 in communication with scoring system 12, monitor 14, center management system 16, a lighting system 20 and a sound system 22.

Figure 2:
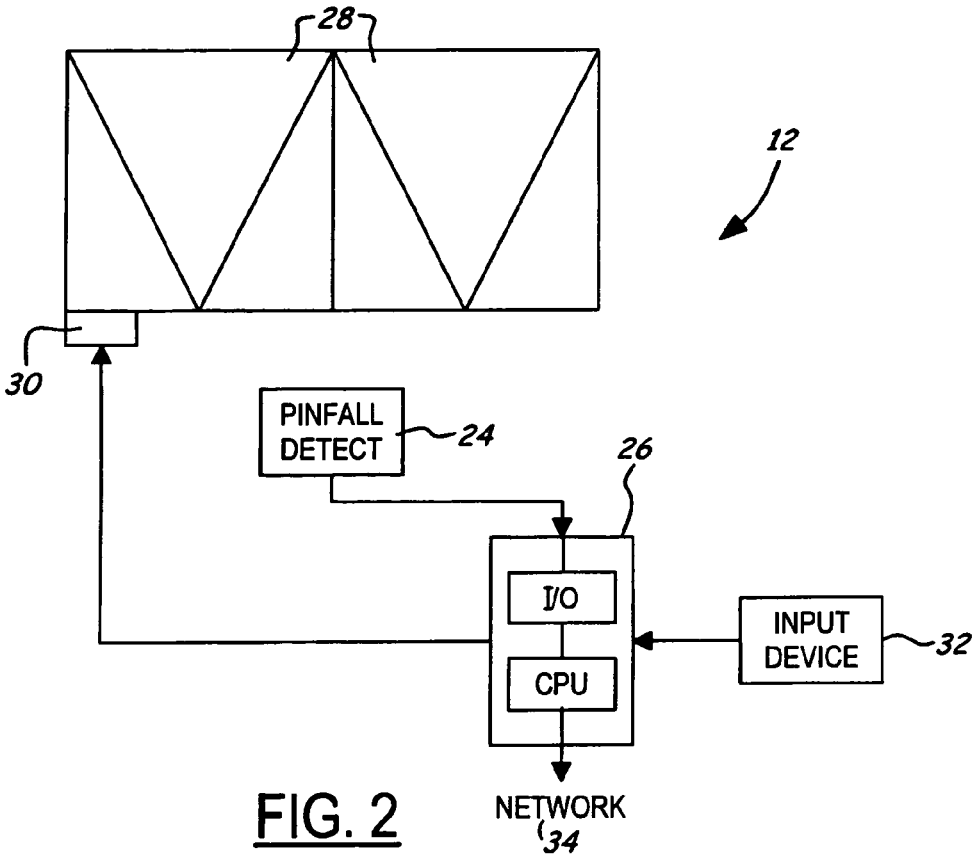
FIG. 2 is a schematic block diagram of an exemplary automatic scoring system of a bowling center control system in accordance with the present invention.

A scoring system is known as seen by reference to U.S. Pat. No. 5,709,607 issued to Mowers et al. entitled AUTOMATIC BOWLING SYSTEM, which is hereby incorporated by reference in its entirety. An exemplary embodiment of a scoring system is illustrated in FIG. 2. In this exemplary embodiment, scoring system 12 is comprised of a pinfall detector 24 and a lane server 26. Lane server 26 is operative to control a pinsetter 28 for at least one lane of a bowling center. A basic lane server is known in the art and is commercially available from Brunswick Bowling & Billiards, Muskegon, Mich. USA as part of Brunswick's scoring systems designated under the tradenames FRAMEWORX, VECTOR or BRUNSWICK CLASSIC, for example; however, this unit provides the basic functionality and is supplemented in functionality as described herein. Lane server 26 can be a personal computer having a central processing unit (CPU) and an input/output board, and may typically be associated with, in a preferred embodiment, eight lanes (best seen in FIGS. 3 and 4). Lane server 26 controls the operational functionality of pinsetter 28 by communicating with a pinsetter controller 30. Pinsetter controller 30 can, for example, cause pinsetter 28 to set up a full compliment of bowling pins at the beginning of a bowling frame; it can cause the pinsetter 28 to lift the pins that remain standing following a throw, sweep the fallen pins off the pin deck, and then put the pins that remain standing back in their respective positions; or it can knock down and sweep away all of the remaining pins following the last throw of a frame. Pinsetter 28 and pinsetter controller 30 are known generally in the art and are commercially available components from, for example, Brunswick Bowling & Billiards, Muskegon, Mich. USA, under the tradename GS-X, for example; however, according to the invention, this functionality is supplemented as described herein.

Lane server 26 is also operative to compute the score for a bowler using a lane under the control of lane server 26, and can determine whether at least one of a plurality of designated bowling events has occurred (e.g., strike, spare, split, gutter ball, etc.) by communicating with pinfall detector 24. Pinfall detector 24 is configured to detect the state of each pin in a compliment of bowling pins and may comprise conventional components known in the art commercially available from, for example, Brunswick Bowling & Billiards, Muskegon, Mich. USA as part of its scoring systems designated under the tradenames FRAMEWORX, VECTOR and BRUNSWICK CLASSIC, for example. In one embodiment, pinfall detector 24 may be, for example purposes, a camera that visually captures the array of pins following a throw, and then sends the image to lane server 26. Lane server 26 then processes the image and determines the number of pins knocked down. It should be noted, however, that this configuration is for exemplary purposes only and is not meant to be limiting in nature. In actuality, pinfall detector 24 can take the form of a number of detection devices such as paddles, for example, located within pinsetter 28 and positioned in such a manner that each paddle corresponds to the position of one pin so that as pinsetter 28 is lowered to lift the standing pins, the standing pins make contact with the corresponding paddles and cause a signal to be generated and delivered to lane server 26, thereby indicating which pins remain standing. It should be noted, however, that this automatic scoring system configuration and the components thereof are exemplary only and are not meant to be limiting in nature.

Figure 3:
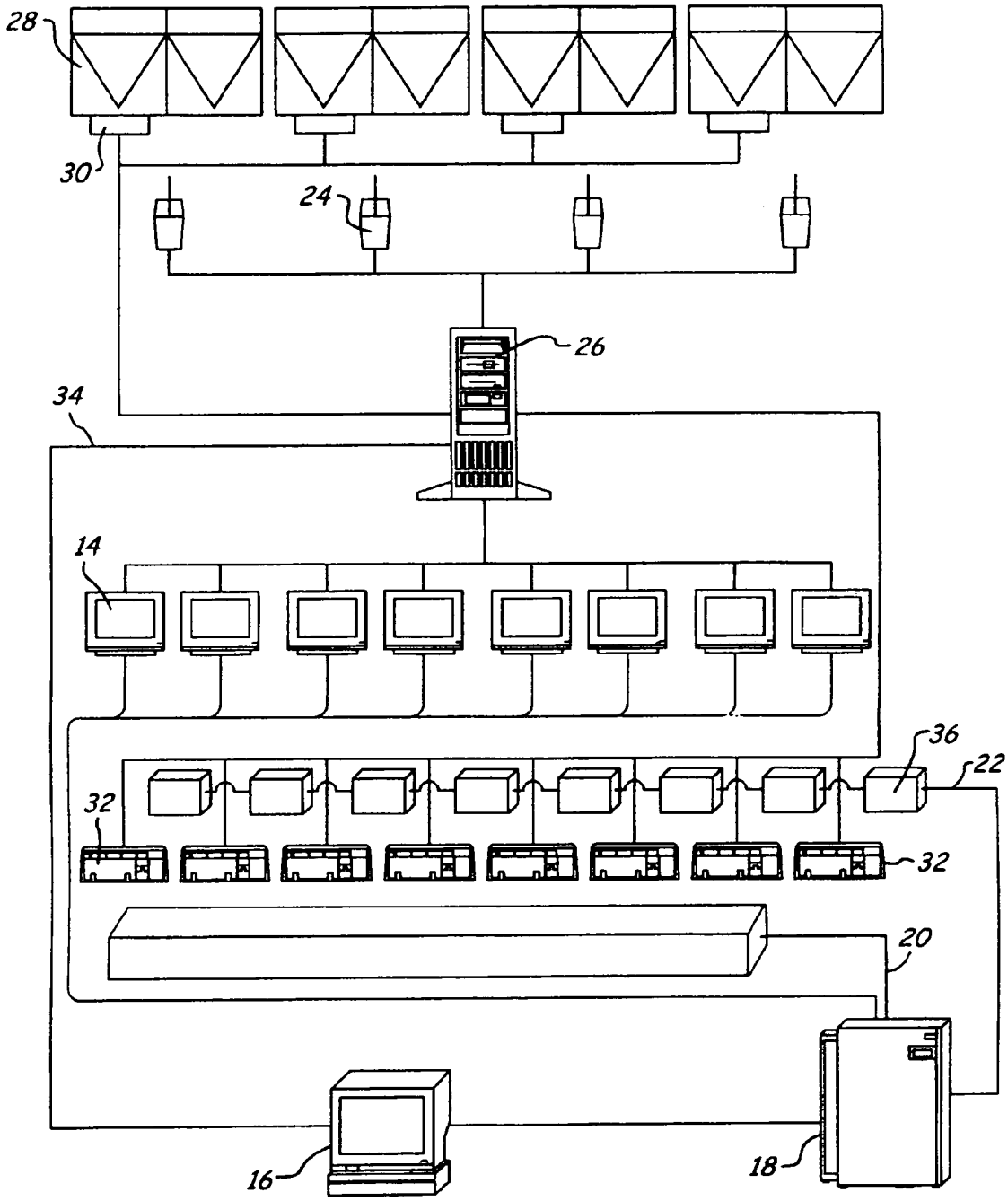
FIG. 3 is a schematic diagram of a simplified bowling center control system in accordance with the present invention.
Figure 4:
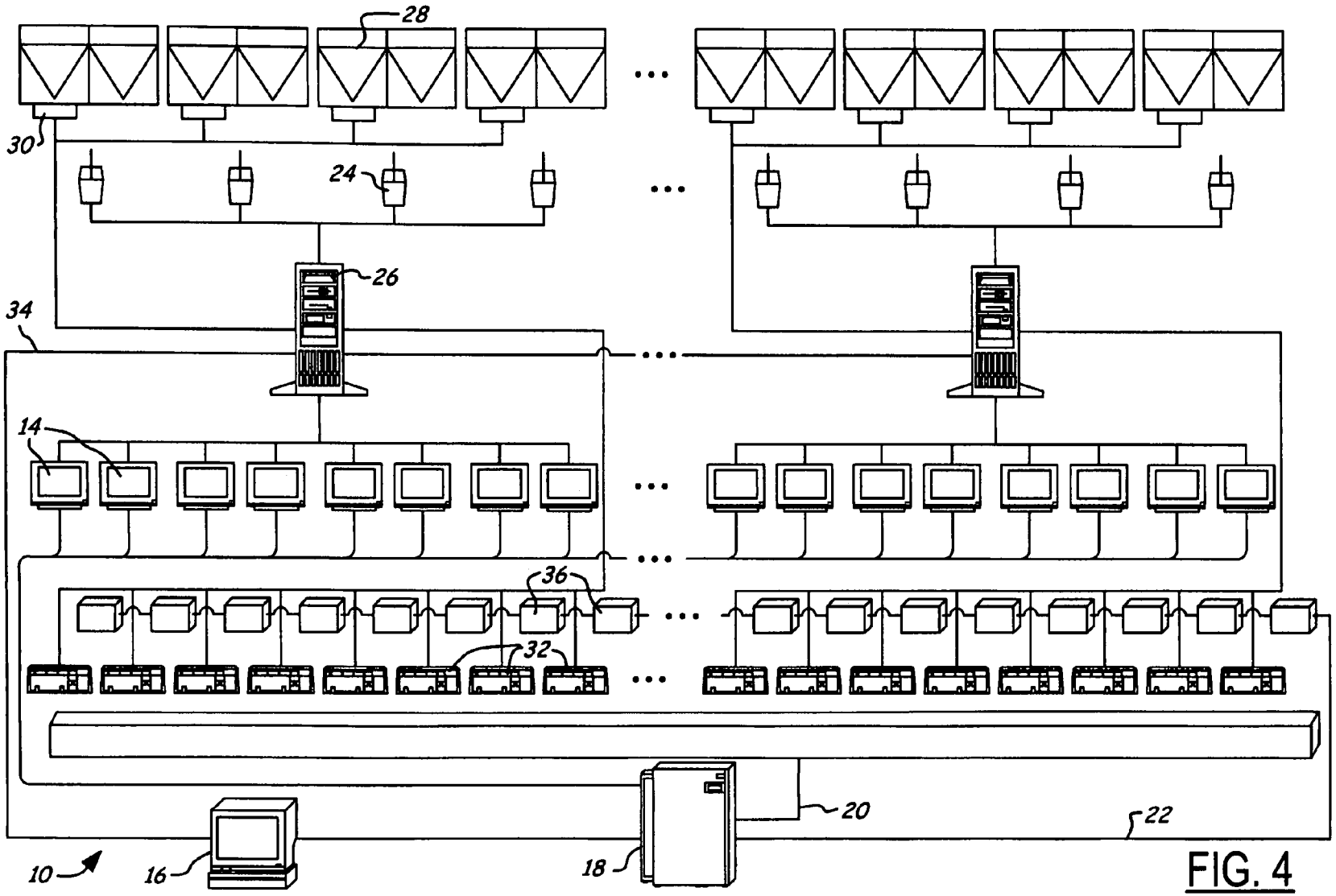
FIG. 4 is a schematic diagram of an enlarged bowling center control system in accordance with the present invention.

Referring now to FIGS. 3 and 4, once the scoring and bowling event information is processed, lane server 26 generates and/or updates a scoresheet that is displayed on monitor 14, or a plurality of monitors, for the bowler to view. Monitor 14 may be proximate to the respective lane being used, may be remotely located, or both. Monitor 14 may take the form, for example, of an overhead monitor, a tabletop mounted monitor positioned in the approach area or bowler area of the lane, a pedestal monitor positioned in or near the approach area of the lane or in the bowler's area, or any combination thereof. In one embodiment, monitor 14 is a flat screen monitor, however, other types and configurations of monitor 14 capable of carrying out the functionality described herein remain within the spirit and scope of the invention. Monitor 14 further includes a control device 15 (best shown in FIG. 1) that is responsive to a control signal generated by lane server 26 which allows for the selection of one of a plurality of video sources, for example, to display either traditional graphics or graphic animations upon the occurrence of particular bowling event, or to display the multimedia functions provided by multimedia server 18 (as will be described in greater detail below), in or out of combination with the scoresheet generated by lane server 26.

Bowling center control system 10 also includes an input device 32 (best shown in FIGS. 2, 3–4, 6, and 10), which can be integral with monitor 14 or apart therefrom, that is in communication with lane server 26 and center management system 16. Input device 32 allows for bowler input into the bowling center control system 10 and/or center management system 16. A bowler may use the input device 32, which may take the form of a keypad, touch screen, or swipe card containing personalized information, for example, to input the bowler's name into the system, and therefore, into the computerized scoresheet provided by lane server 26. Input device 32 may also be used to correct a scoring error, to place food and drink orders (through center management system 16, for example), or for other communication purposes. Additionally, input device 32 is in communication, either directly or indirectly, with multimedia server 18, and therefore, can be used to allow a bowler to select a type of multimedia entertainment style provided by multimedia server 18, as will be discussed below.

Figure 5:
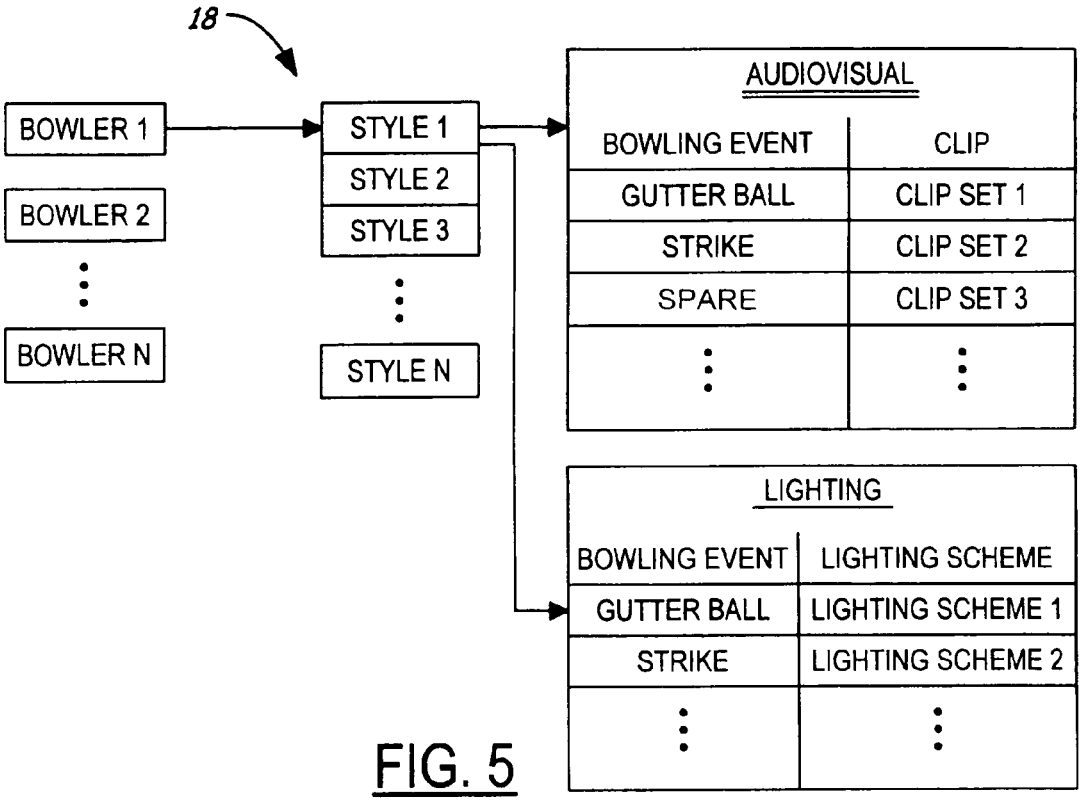
FIG. 5 is a flow chart showing the data structure of an exemplary multimedia server of a bowling center control system in accordance with the present invention.

With reference to FIGS. 3–5, multimedia server 18 may comprise conventional software, commercially available from, for example, Prophet Systems Innovations of Ogallala, Nebr. USA, that is loaded and executed on conventional hardware, for example. As set forth above, multimedia server 18 is in communication with input device 32 and is configured with a plurality of entertainment styles having predetermined audiovisual, lighting and sound characteristics, wherein each style has its own theme. Multimedia server 18 is further configured with multimedia content corresponding to each of the audiovisual, lighting and sound characteristics of each entertainment style. Each entertainment style provides for particular predetermined sound content (i.e., music) for each individual lane or group of lanes, and predetermined audiovisual and lighting content for each individual bowler or groups of bowlers on a lane or lanes. This allows for a bowler to select an entertainment style, and therefore the corresponding audiovisual, lighting and sound content, that has an associated theme the bowler prefers. Accordingly, a bowler can customize and tailor the audiovisual, lighting and sound characteristics, and accordingly, the overall environment for his particular lane and/or bowling game in accordance with his taste.

In operation, a bowler's selection is input into the system by way of input device 32 and is communicated to lane server 26. Lane server 26 is configured to process this information and send it on to multimedia server 18 along with scoring and bowling event information. It should be noted, however, that while input device 32 is used to, among other things, select the entertainment style to be implemented by multimedia server 18, this is simply one embodiment of the invention. In actuality, any device that communicates with the network/system can be used. For instance, a swipe card can be programmed with a bowler's desired selections and then swiped through a scanning device each time the bowler goes to a bowling center. In another embodiment, a kiosk located remotely to the lane may be used to input a bowler's selections. In yet another embodiment, the attendant at the bowling center's front counter can make the selections that the bowler desires. In yet a further embodiment, a wireless input device can be used to communicate with the system. In yet another further embodiment, a bowler can use the internet to make his selections from home prior to coming to the bowling center. It should be noted, however, that these various embodiments are exemplary only and not limiting in nature. Rather, it will be apparent to those skilled in the art that any input device having access to the system will suffice.

Accordingly, once the scoring and bowling event information is assimilated by lane server 26, it broadcasts the information on a network 34, such as an Ethernet network, for example, along with the entertainment style selected by the bowler. This broadcasted information and data can then be received by at least center management system 16 and multimedia server 18, both of which are connected to network 34. It should be noted, however, that the Ethernet network is provided for exemplary purposes only and is not meant to be limiting in nature. Other communication networks, such as fiber optic networks, remain within the spirit and scope of this invention. Provided the display of multimedia functions is selected, as discussed above with respect to monitor control device 15, multimedia server 18 processes the selected style, and then causes the corresponding multimedia content associated with the selected entertainment style to be implemented. This includes, for example, playing the corresponding type or genre of sound on the corresponding lane or lanes, controlling the lighting characteristic corresponding to the selected style that is displayed on and around the bowler's lane or on lane dividers 17 (i.e., screens or moveable walls positioned in between adjacent lanes, and best shown in FIG. 6), if provided, and controlling the audiovisual characteristic (i.e., video and associated audio, for example) corresponding to the selected style displayed on and around monitor 14 or other surfaces upon which the video can be projected. In one exemplary embodiment, monitor 14 is hardwired to multimedia server 18 using conventional red, green, blue (RGB) wiring.

The multimedia content associated with the audiovisual characteristic is provided by a content provider and, as set forth above, different predetermined portions of the audiovisual content have different themes corresponding thereto. These themes may include, for example, sports or particular sports teams, particular types or genres of movies or television programs, specific movies or television programs, or themes relating to specific geographical locations. As set forth above, each bowler may select his own entertainment style and corresponding audiovisual content to be associated with him individually and to be played or implemented on his particular lane when he is bowling. A bowler or group of bowlers can also select one entertainment style and the corresponding audiovisual content for all of the bowlers on a particular lane or lanes, or default content can be implemented. In each entertainment style, the audiovisual content includes, for example, clips of different movies or television shows or sporting events. These clips may be the actual clips or may be modified to better correlate with bowling and/or bowling events, and the clips can be updated by content providers periodically. With reference to FIG. 5, typically these clips, and the associated audio features corresponding to the clips (i.e., voice, sound effects, music, etc.), are prompted and played in part upon the occurrence of at least one of a designated number of bowling events (i.e., strike, spare, split, gutter ball, etc.), similar to how conventional graphics and graphic animations are played. Each clip can also be designated or assigned to each type of bowling event. For example, four clips may be assigned to be played when there is a gutter ball. Accordingly, each time the bowler who is associated with that selected entertainment style throws a gutter ball, either one of the four clips or any combination thereof will be played. However, the display of clips or other audiovisual features are not limited to only certain designated bowling events. Rather some or all of the clips may be displayed on an ongoing basis over the course of the bowler's visit to the bowling center, regardless of the occurrence of a bowling event.

Initially, content providers may distribute these audiovisual packages on CD-ROM, however, other media, such as satellite and broadband, may also be used. Accordingly, in operation, upon the occurrence of a bowling event, a signal indicative of the event is generated by lane server 26 and sent to multimedia server 18. Once this signal is received, multimedia server 18 is configured to generate an output signal that is operative to reproduce at least certain portions of the audiovisual content of the bowler's selected entertainment style, and to deliver the output signal to, for example, monitor 14, where the content is displayed.

With respect to the lighting characteristic of the entertainment styles, and similar to the audiovisual characteristic described above, different predetermined portions of the lighting content have different themes corresponding thereto. Accordingly, when a bowler selects his desired entertainment style, he selects certain lighting content associated with that entertainment style to be displayed by lighting system 20. As with the audiovisual packages described above, one entertainment style can be selected for all of the bowlers on a given lane, and therefore, the lighting content associated with that entertainment style can be displayed for all of the bowlers on a lane, or default lighting content can be implemented. Lighting content corresponding to the entire bowling center may also be used, whereby, for example, all of the lights of a bowling center can be focused on one lane if a particular occurrence has taken place on that lane (i.e., a strike, for example). Additionally, with reference to FIG. 5, different portions of the lighting content associated with each entertainment style can be assigned to a different bowling event so that upon the occurrence of that event, the designated lighting content (designated as Lighting Scheme 1, Lighting Scheme 2, etc. in FIG. 5) will be displayed. Accordingly, the lighting characteristic can be prompted, in part, by the occurrence of a designated bowling event. The lighting is controlled by multimedia server 18 by way of conventional DMX technology, or by any number of known control means. As stated above, the lighting content can be displayed in the area encompassing and immediately surrounding the lane being used by the bowler, on other lanes proximate to the bowler's lane, or throughout the bowling center. The lighting display can also be displayed on other surfaces such as lane dividers 17 (i.e., screens or moveable walls, best shown in FIG. 6), should they be provided. Accordingly, in operation, upon the occurrence of a bowling event, a signal indicative of the event is generated by lane server 26 and sent to multimedia server 18. Multimedia server 18 is configured to then generate an output signal that is operative to reproduce at least certain portions of the lighting content corresponding to the bowler's selected entertainment style, and to deliver the output signal to, for example, lighting system 20, which causes the lighting content (i.e., light scheme) to be displayed.

Therefore, with particular reference to FIG. 5, in bowling center control system 10, a bowler can select an entertainment style, which will then display audiovisual content and lighting content corresponding the selected style upon the occurrence of at least one of a plurality of designated bowling events.

Figure 11:
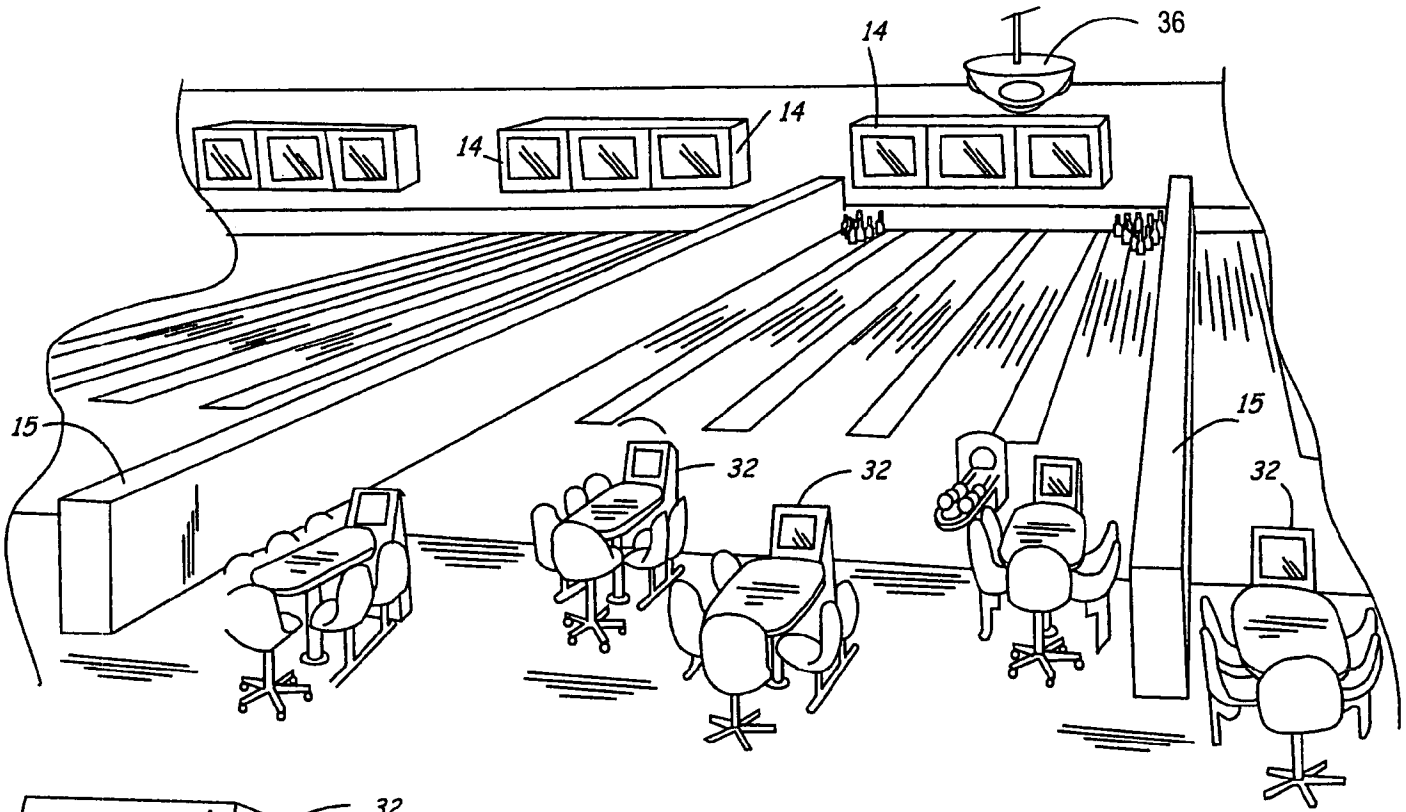
FIG. 11 is perspective view of an alternate embodiment of a bowling center shown in FIG. 6 in accordance with the present invention.
Figure 10:
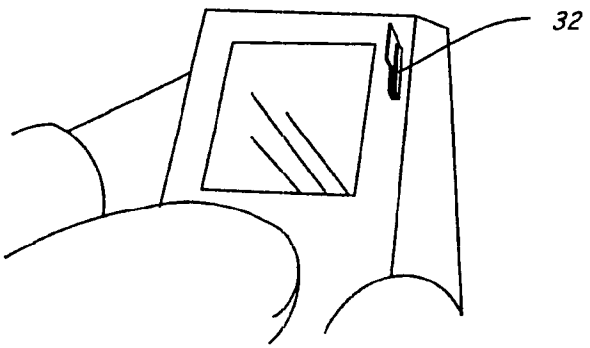
FIG. 10 is an enlarged view of a portion of an exemplary user input device similar to that shown in FIG. 6 in accordance with the present invention.

With respect to the sound characteristic of the entertainment style, in one embodiment, this characteristic is selected on a lane by lane basis as opposed to an individual bowler basis, and accordingly, is associated with a particular lane or lanes rather than a particular individual bowler. Sound system 22 is used to play the content associated with the sound characteristic of the selected entertainment style, and is controlled by multimedia server 18. Accordingly, multimedia server 18 is configured to generate an output signal that is operative to reproduce at least certain portions of the sound content corresponding to the selected entertainment style, and to deliver the output signal to sound system 22, which causes the sound content to be played. In one embodiment, hemispherical speakers 36 are mounted overhead (best shown in FIG. 11) to direct and contain the selected sound, be it music or sound corresponding to the sound characteristic or audio corresponding to the audiovisual characteristic of the entertainment style (i.e., movies, television programs, sports, music, etc.), for example, within the area of the particular lane. These speakers are used to prevent the sound played on one lane from interfering with the sound played on another lane. It should be noted, however, that this speaker configuration is exemplary only, and not limiting in nature. Other speaker arrangements exist that remain within the spirit and scope of this invention. As with the audiovisual content discussed above, the content associated with the sound characteristic is made up of a library or catalog of sound content that is provided by a content provider. Accordingly, the library or catalog, and therefore the sound content, can be distributed and updated in the same manner as described above regarding the audiovisual content.

The ability to select a particular style of entertainment incorporating audiovisual, lighting and sound characteristics by a single multimedia server 18 results in one integrated system to control all of the entertainment features of the bowling center, as opposed to conventional bowling center control systems wherein each of the audiovisual, lighting and sound systems or characteristics are relatively separate and distinct from each other, and cannot be selected by a bowler or customized to the bowler's taste.

Accordingly, with reference to FIGS. 1–5, a bowling center control system 10 is provided. Bowling center control system 10 includes at least an automatic scoring system 12 corresponding to at least one lane; a monitor 14 corresponding to at least one lane; a multimedia server 18 and a user input device 32. Additionally, a center management system 16 may be provided that is in communication with bowling center control system 10, and allows for the universal control over the entire bowling center.

Automatic scoring system 12 determines the number of fallen pins and the position formerly occupied by those fallen pins in order to compute a score for a bowler following each throw of a ball in a bowling game. Automatic scoring system 12 also determines whether one of a plurality of designated bowling events has occurred. Scoring system 12 then sends the computed score in the form of a computerized scoresheet to monitor 14 to be displayed, and broadcasts the scoring and bowling event information onto network 34. Scoring system 12 may additionally cause a graphical image/animation to be displayed on monitor 14, provided a designated bowling event has been detected. These tasks can all be accomplished by a combination of pinfall detector 24 and lane server 26.

Scoring system 12 is also in communication with input device 32, which can be used for entering a bowler's name into the system and/or computerized scoresheet, as well as to select one of a plurality of entertainment styles (i.e., audiovisual, lighting and sound characteristics). The selections made by a bowler are processed by scoring system 12, and then broadcast, along with the scoring and bowling event information, onto network 34. Multimedia server 18 receives the broadcast and customizes the entertainment by implementing and controlling predetermined portions of multimedia content contained on multimedia server 18 corresponding to each of the audiovisual, lighting and sound characteristics of the selected entertainment style, including the display of audiovisual and or lighting displays, in accordance with the bowler's selection upon the occurrence of at least one of a plurality of bowling events.

Figure 7:
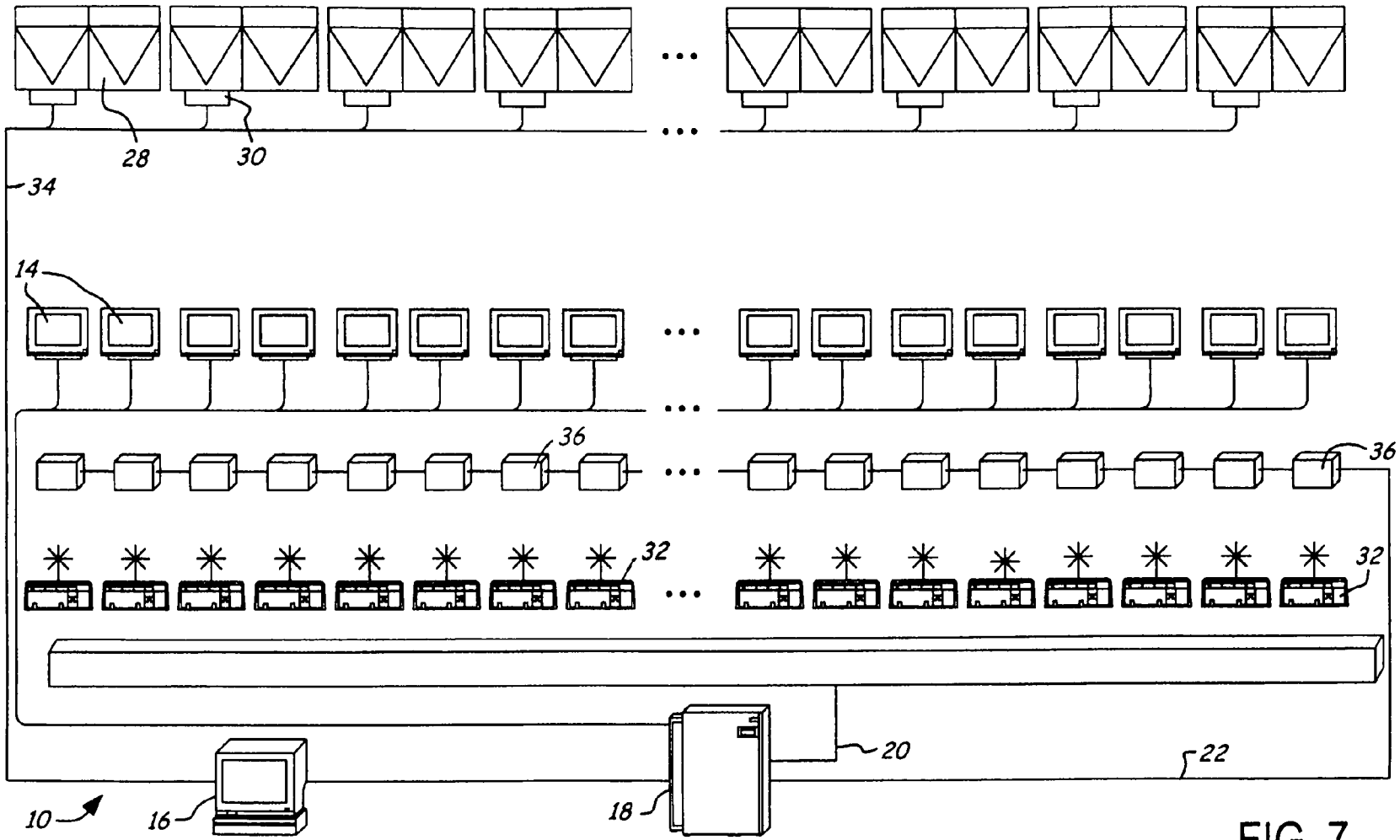
FIG. 7 is a schematic diagram of an alternate embodiment of a bowling center control system in accordance with the present invention.

With reference to FIG. 7, an alternate embodiment of bowling center control system 10 is illustrated. This embodiment is essentially comprised of the same components as the above-described embodiment, however, the scoring function is decoupled from the system. In this embodiment, pinsetter controller 30 includes a CPU (not shown) and an input/output interface (not shown). Controller 30 is configured to receive pinfall information, and then compute the score for a bowler following each throw. Controller 30 then transmits the computed score in the form of a computerized spreadsheet across a given channel, for example, to monitor 14 for display, and broadcasts the scoring information onto network 34, such as an Ethernet network. This information is then received by, for example, center management system 16 and multimedia server 18. Multimedia server 18 determines, based on the scoring data compiled by pinsetter controller 30 and the entertainment style selected by the bowler via input device 32, what portion of the multimedia content corresponding to the audiovisual, lighting and sound characteristics to implement and when to implement this content. Multimedia server 18 then implements the audiovisual, lighting and sound characteristics corresponding to the selected entertainment style selected. In this embodiment input device 32 is a wireless device, however, this is exemplary only and not meant to be limiting in nature. This embodiment allows for improvements in entertainment technology to proceed without losing investment in scoring systems that can become outdated.

An additional feature of bowling center control system 10 is that it can be used as a revenue generating mechanism, which, in one embodiment, comprises advertising revenue. This can be accomplished by configuring server 18 to play various multimedia content provided by content producers/providers, such as motion picture companies and record companies. In effect, playing trailers or clips of their movies or new songs from their albums allows for the advertising of their products. A key feature is the ability of server 18 to maintain statistics indicative of the "audience" (e.g., the numbers of players who would view the content, self-identified interests, etc.). A key to the revenue piece of the system is to provide commitments and supporting data to advertisers as to the audience, which drives the revenue. Server 18 may also be configured to provide a retail outlet for these providers by offering products to the bowlers for purchase by simply entering some information into the network using input device 32, for example.

Figure 8:
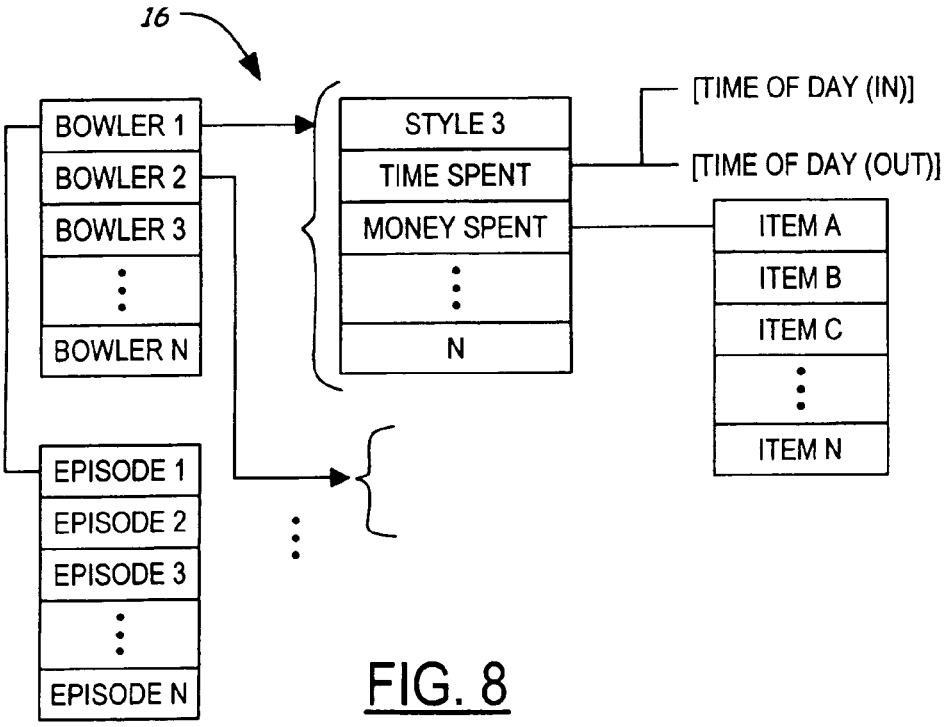
FIG. 8 is a flow chart showing the data structure of a bowling center control system in accordance with the present invention.
Figure 6:
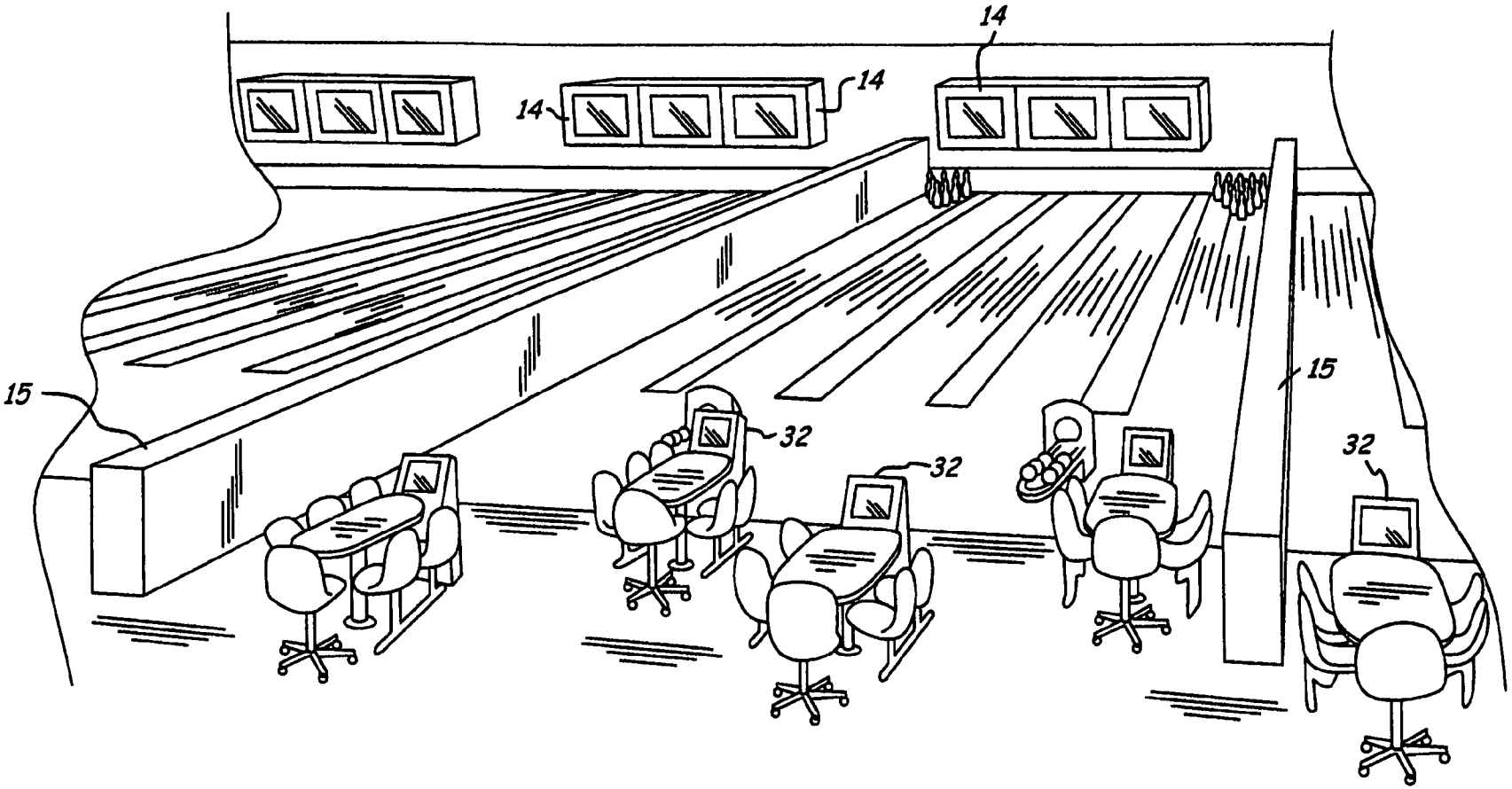
FIG. 6 is a perspective view of a bowling center in accordance with the present invention.

With reference to FIG. 8, a further feature of the present invention is that bowling center control system 10 can be configured to compile and store information (i.e., demographics and psychographics) on the bowlers visiting that particular bowling center, as well as money and time spent at the bowling center, for example. In one embodiment, the center management system 16 includes a software program or database that reads, stores, and assimilates information regarding the type and amount of food ordered by way of input device 32, for example, the types of entertainment styles (i.e., audiovisual, lighting and sound characteristics) that bowlers are selecting and the frequency of these selections. Center management system 16 may also include a timer and a time stamp means to allow information to be gathered regarding the amount of time spent at the bowling center and the days and times of the day bowlers visit that particular bowling center. In another embodiment, a separate, distinct system component that is dedicated to the compiling and storing of this information is provided.

Regardless of the structural embodiment, however, this compiled information allows the bowling center owner to track trends in an effort to better market her bowling center and to better serve the needs of her customers. For example, if, based on the compiled information, a bowling center is finding that a majority of its customers are selecting an entertainment style having a country music theme, the center owner can have a country music night at the bowling center to attract a large number of customers or the bowling center can change the type of styles offered to bowlers to better suit the preferences of the clientele of that particular bowling center. Likewise, if a bowling center is finding that the center is less busy at a certain time of day, the owner can have promotions to get customers to visit the bowling center at the down times or less busy times of the day or days of the week. Similarly, this compiled information allows a bowling center to track, for example, the volume of sales for each particular good or food and beverage product offered for sale by the center on a center-wide basis, or on an individual bowler basis. Therefore, bowlers can put the items that they purchase on a tab that can be cashed out at a later time, and centers can monitor and determine the favorite or most popular on-sale items.

Accordingly, as shown in FIG. 8, each time the user visits the bowling center (designated as an episode), the style selections he makes, the time of day and the amount of time spent, and the amount of money spent, for example, are recorded, compiled, and stored in separate "files" (shown as Episode 1, Episode 2, etc. in FIG. 8). A center operator can then review and track a user's likes, dislikes and overall history. This allows for the center to track, on a user by user basis or on a center-wide basis, what entertainment styles, food and drink, time of day and what days are most popular, as well as how much money is generated and when and by whom this money is spent. Accordingly, management system 16 can provide a bowling center operator a rather easy way of compiling demographic and psychographic data in order to better serve their customer base and to better market their bowling center.

Figure 9:
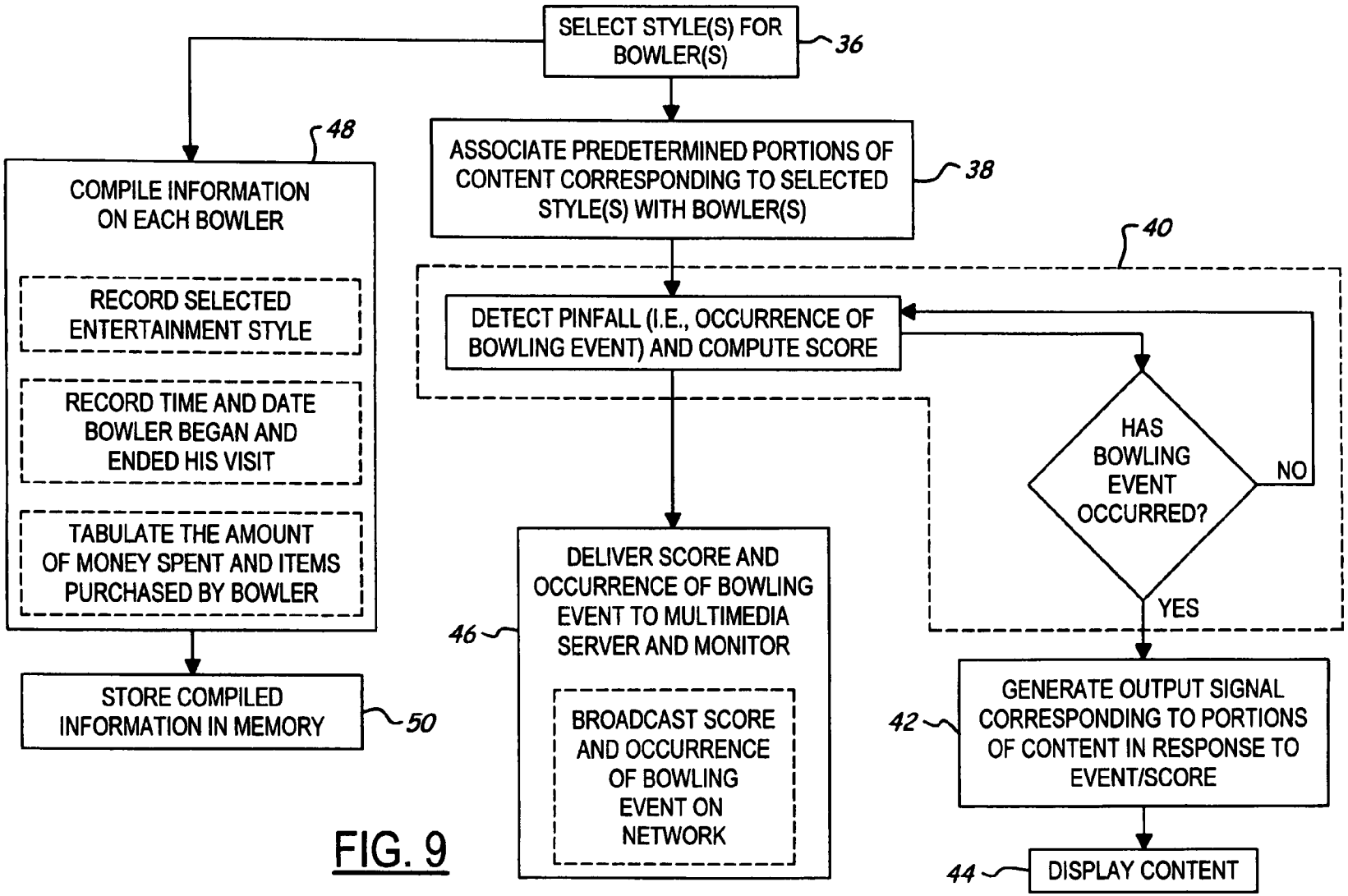
FIG. 9 is a flow chart showing a method of controlling the delivery of entertainment in a bowling center in accordance with the present invention.

With reference to FIG. 9, an inventive method of controlling the delivery of entertainment in a bowling system is shown. Step 36 entails selecting for a bowler or bowlers, one of a plurality of entertainment styles having predetermined audiovisual, lighting and sound characteristics corresponding to predetermined multimedia content stored on multimedia server 18. Step 38 includes associating predetermined portions of the predetermined multimedia content with the bowler based on the entertainment style selected by or for that bowler. Step 40 includes determining whether at least one of a plurality of predetermined bowling events has occurred. This step includes detecting the pinfall of a compliment of pins, and computing a score for a particular bowler. If it is determined that a bowling event has occurred, then step 42 is implemented which includes generating an output signal in multimedia server 18. The output signal is operative to reproduce at least certain portions of the multimedia content associated with the predetermined audiovisual, lighting and sound characteristics in response to the bowling event occurrence. Step 44 includes displaying the generated portions of the multimedia content associated with the audiovisual, lighting and sound characteristics. A further step, step 46, includes delivering the scoring and bowling event information to lane monitor 14 for display, and to multimedia server 18; and further includes the substep of broadcasting the information onto network 34 which is connected multimedia server 18. A yet further step 48 is presented which includes compiling information about the bowler. This step includes the substeps of recording the entertainment style selected by the bowler, recording the time and date the bowler began and ended his visit, and tabulating the amount of money spent and items purchased by the bowler during his visit. Step 50 includes storing the information compiled in step 48 in a memory. In one exemplary embodiment, center management system 16 is configured to carry out steps 48 and 50, however, it should be noted that this configuration is exemplary only and not limiting in nature.

While only those embodiments set forth above have been described in detail, other configurations and embodiments for the present invention exist that are within the spirit and scope of the invention.

What is claimed:

1. A bowling center control system comprising:

an input device configured for input of a bowler's selection of one of a plurality of entertainment styles, each style having predetermined audiovisual, lighting and sound characteristics; and a multimedia server in communication with said input device configured with multimedia content corresponding to each of said audiovisual, lighting and sound characteristics of each of said plurality of entertainment styles, said server being further configured to associate predetermined portions of said content with said bowler in response to said bowler's selected one entertainment style, said server being further configured to generate an output signal operative to reproduce at least certain portions of said predetermined portions of said content corresponding to said audiovisual, lighting and sound characteristics of said bowler's selected one entertainment style in response to a signal indicative of an occurrence of a bowling event associated with said bowler.

2. A bowling center control system in accordance with claim 1 wherein said bowling event is one of a plurality of bowling events, and further wherein said output signal varies depending on the nature of said one bowling event.

3. A bowling center control system in accordance with claim 1 further comprising a center management system in communication with said input device and said multimedia server.

4. A bowling center control system in accordance with claim 3 wherein said center management system is configured to compile information corresponding to said bowler.

5. A bowling center control system in accordance with claim 4 wherein said center management system is configured to compile information including at least said bowler's selected one entertainment style, the amount of time spent at said bowling center, the time of day said bowler visited said bowling center, the amount of money spent by said bowler and the items purchased by said bowler.

6. A bowling center control system in accordance with claim 1 wherein said multimedia server is configured with multimedia content corresponding to said plurality of entertainment styles wherein each one of said plurality of entertainment styles is based on themes including at least particular movies, genres of movies, particular television shows, genres of television shows, sports, particular sports teams, particular games, genres of games, and the geographical location of said bowling center.

7. A bowling center control system in accordance with claim 1 further comprising:

an automatic scoring system corresponding to at least one bowling lane and in communication with said input device and said multimedia server, wherein said scoring system is configured to compute said bowler's score and to determine said occurrence of said bowling event following each ball thrown down a lane by said bowler in a bowling game; and a display monitor configured to display predetermined audiovisual characteristics corresponding to said one selected entertainment style in response to said output signal generated by said multimedia server, and said score computed by said automatic scoring system.

8. A bowling center control system in accordance with claim 7 further comprising a network to which said multimedia server and said automatic scoring system are connected, and upon which said computed score, said occurrence of said bowling event, and said selected entertainment style are broadcast.

9. A bowling center control system in accordance with claim 8 wherein said network is an Ethernet network.

10. A bowling center control system in accordance with claim 7 wherein said automatic scoring system includes a pinfall detector a lane server wherein said pinfall detector is in communication with said lane server, said pinfall detector being configured to detect the state of each bowling pin in a compliment of bowling pins and said lane server being configured to generate a plurality of graphics, and to control a pinsetter via a pinsetter controller.

11. A bowling center control system in accordance with claim 10 further comprising a control device to allow for the switching between the display of said plurality of graphics and said multimedia content.

12. A bowling center control system in accordance with claim 10 wherein said lane server is comprised of a central processing unit and an input/output board, and is further configured to compute said bowler's score and to determine said occurrence of said bowling event in response to the detection of said pinfall detector.

13. A bowling center control system in accordance with claim 10 wherein said display monitor is an overhead monitor.

14. A bowling center control system in accordance with claim 1 wherein said at least certain portions of said predetermined characteristics include said audiovisual and lighting characteristics.

15. A bowling center control system in accordance with claim 1 further comprising at least one speaker for each one of a number of lanes of said bowling center to allow for the broadcast of said sound characteristic of said plurality of entertainment styles.

16. A bowling center control system in accordance with claim 15 wherein said speaker is a hemispherical speaker positioned above the approach area of said lane.

17. A bowling center control system comprising:

an input device configured for input of a bowler's selection of one of a plurality of entertainment styles, each style having predetermined audiovisual, lighting and sound characteristics;

a multimedia server in communication with said input device configured with multimedia content corresponding to each of said audiovisual, lighting and sound characteristics of each of said plurality of entertainment styles, said server being further configured to associate predetermined portions of said content with said bowler in response to said bowler's selected one entertainment style, said server being further configured to generate an output signal operative to reproduce at least certain portions of said predetermined portions of said content corresponding to said audiovisual, lighting and sound characteristics of said bowler's selected one entertainment style in response to a signal indicative of an occurrence of a bowling event associated with said bowler; and at least one moveable lane divider upon which said multimedia content corresponding to said lighting characteristic of said plurality of entertainment styles can be displayed in addition to the area proximate to said lane on which said bowler is bowling.

18. A bowling center control system in accordance with claim 1 wherein said user input device is a keypad.

19. A bowling center control system in accordance with claim 1 wherein said user input device is a touch screen.

20. A bowling center control system in accordance with claim 1 wherein said user input device is a swipe card.

21. A method of controlling the delivery of entertainment in a bowling center comprising the steps of:

selecting one of a plurality of entertainment styles corresponding to predetermined multimedia content stored on a multimedia server, wherein each of said entertainment styles has predetermined audiovisual, lighting and sound characteristics;

associating predetermined portions of said predetermined multimedia content with a bowler based on said bowler's selected one entertainment style;

determining whether at least one of a plurality of predetermined bowling events has occurred;

generating in said multimedia server an output signal operative to reproduce at least certain portions of said predetermined multimedia content associated with said predetermined audiovisual, lighting and sound characteristics of said one selected entertainment style responsive to said occurrence of at least one of said plurality of predetermined bowling events; and displaying said generated portions of said multimedia content associated with said audiovisual, lighting and sound characteristics.

22. A method of controlling the delivery of entertainment in a bowling center comprising the steps of:

selecting one of a plurality of entertainment styles corresponding to predetermined multimedia content stored on a multimedia server, wherein each of said entertainment styles has predetermined audiovisual, lighting and sound characteristics and wherein said selecting step further includes the substep of selecting one of said plurality of entertainment styles for each bowler bowling on a given lane;

associating predetermined portions of said predetermined multimedia content with a bowler based on said bowler's selected one entertainment style;

determining whether at least one of a plurality of predetermined bowling events has occurred;

generating in said multimedia server an output signal operative to reproduce at least certain portions of said predetermined multimedia content associated with said predetermined audiovisual, lighting and sound characteristics of said one selected entertainment style responsive to said occurrence of at least one of said plurality of predetermined bowling events; and displaying said generated portions of said multimedia content associated with said audiovisual, lighting and sound characteristics.

23. A method of controlling the delivery of entertainment in a bowling center in accordance with claim 21 wherein said determining step includes:

detecting the state of each pin in a compliment of bowling pins in a bowling game following a throw of a ball by a bowler; and computing a score for said bowler.

24. A method of controlling the delivery of entertainment in a bowling center in accordance with claim 23 further comprising the step of delivering said computed score and said determination of the occurrence of at least one of said plurality of predetermined bowling events to a display monitor and said multimedia server.

25. A method of controlling the delivery of entertainment in a bowling center in accordance with claim 24 wherein said delivering step includes the substep of broadcasting said computed score and said occurrence of at least one of said plurality of bowling events onto an Ethernet network to which said multimedia server is connected.

26. A method of controlling the delivery of entertainment in a bowling center in accordance with claim 21 further comprising the steps of:

compiling information corresponding to said bowler; and storing said compiled information in a memory.

27. A method of controlling the delivery of entertainment in a bowling center in accordance with claim 26 wherein said compiling step includes the substeps of:

recording said selected one entertainment style;

recording the amount of time spent at said bowling center and the time of day said bowler visited said bowling center; and tabulating the amount of money spent by said bowler and the items purchased by said bowler.

* * * * *